United States Patent [19]

Barlow et al.

[11] Patent Number: 4,485,587

[45] Date of Patent: Dec. 4, 1984

[54] REVERSING MECHANISM FOR A TOY MOTOR DRIVEN WHEELED VEHICLE

[75] Inventors: Gordon A. Barlow; John R. Krutsch, both of Glenview, Ill.

[73] Assignee: Gordon Barlow Design, Skokie, Ill.

[21] Appl. No.: 456,584

[22] Filed: Jan. 7, 1983

[51] Int. Cl.[3] ..... A63H 17/40

[52] U.S. Cl. ..... 446/442; 192/21

[58] Field of Search ..... 46/212, 211, 206, 209, 46/208, 201, 263; 192/21, 51

[56] References Cited

U.S. PATENT DOCUMENTS

| | | | |
|---|---|---|---|
| 25,733 | 10/1859 | Hendy | 192/21 |
| 2,146,021 | 2/1939 | Lohr et al. | 46/212 |
| 2,172,416 | 9/1939 | Swenson | 46/212 X |
| 2,352,483 | 6/1944 | Jandasek | 192/21 X |
| 2,625,831 | 1/1953 | Saunders, Jr. | 46/212 |
| 3,757,459 | 9/1973 | Buck et al. | 46/202 |
| 4,087,935 | 5/1978 | Edmisson et al. | 46/202 |
| 4,135,328 | 1/1979 | Yamasaki | 46/202 |
| 4,201,011 | 5/1980 | Cook | 46/209 |
| 4,290,227 | 9/1981 | Shimamura | 46/206 |

*Primary Examiner*—Mickey Yu

*Attorney, Agent, or Firm*—Kinzer, Plyer, Dorn & McEachran

[57] ABSTRACT

A reversing mechanism for a toy motor driven wheeled vehicle having a driven axle with attached wheels supported on a chassis. The axle is supported on the chassis so that it is shiftable laterally relative to the chassis. The reversing mechanism includes an apparatus to shift the driven axle laterally relative to the chassis between forward and reverse driving positions upon engagement of the front or rear of the vehicle with the firm obstructing object. A pair of spur gears are positioned on the driven axle and are spaced in generally fixed relation to each other with each gear freely rotatable on the driven shaft. The shaft is freely slidable through the gears. A clutch member is affixed to the driven axle for rotation therewith and is positioned between the spur gears. The clutch member has rotationally opposite effective one-way clutch teeth on the sides thereof facing the spur gears. Complementary one-way clutch teeth are formed on the sides of the spur gears facing the clutch member and these are engageable with the complementary one-way teeth on the clutch member as the clutch member is moved into engagement with one of the spur gears and out of engagement with the other spur gear upon lateral shifting of the driven axle to one of the forward and reverse driving positions. A pair of oppositely rotatable idler gears are driven by the toy vehicle motor. Each idler gear meshes with one of the spur gears to thereby drive the driven axle through the spur gear that is in engagement with the clutch member.

11 Claims, 19 Drawing Figures

85
29
121
57
121
23
23
17
17
227
16
45
235
235
231
229
77
89
89
11
133
115
113
118
119
117
225
133
131
181
49
14
137
183
61
9
9
154
13
139
143
145
131
153
135
103
62
25
21
207
141
111
109
101
105
193
217
217
191
187
19
154
151
107
219
21
219
205
189
195
15
25
244
244
241
253
251
87

Fig. 5.
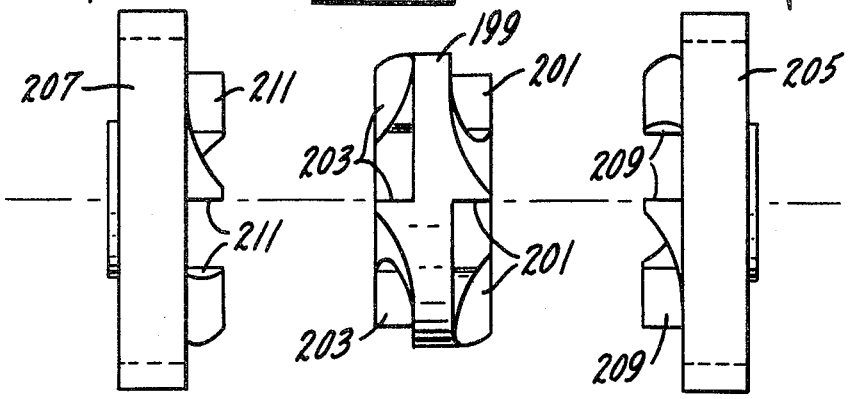
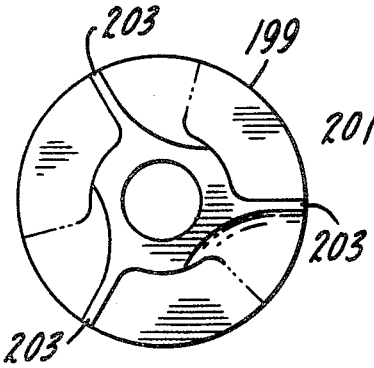
Fig. 6.
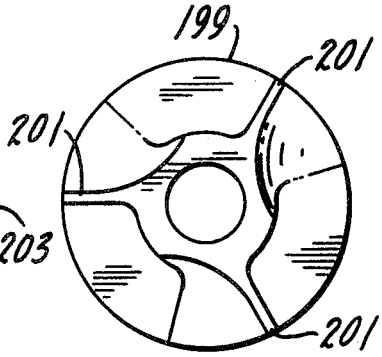
Fig. 7.
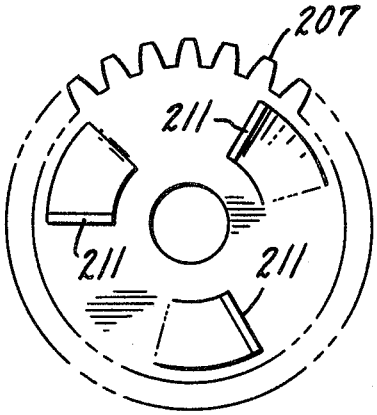
Fig. 8.
Fig. 9.
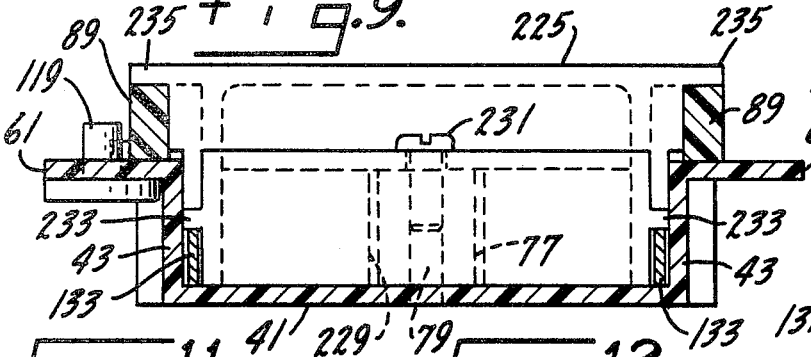
Fig. 10.
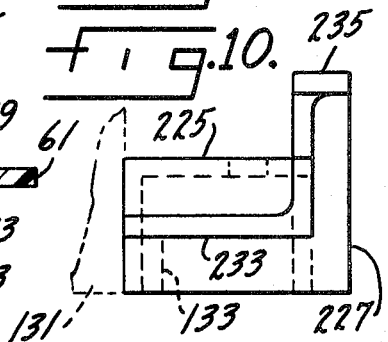
Fig. 11.
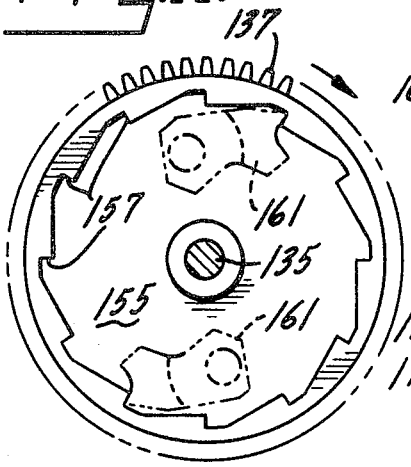
Fig. 12.
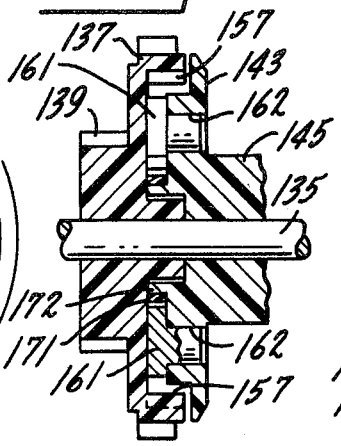
Fig. 13.
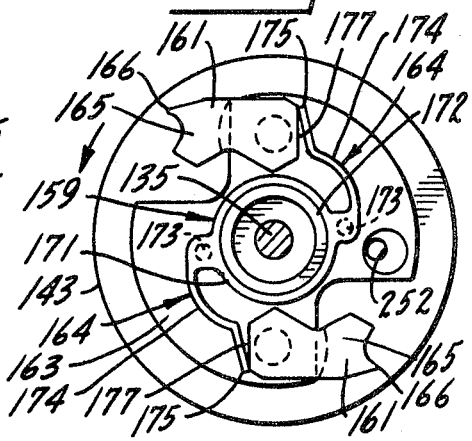

REVERSING MECHANISM FOR A TOY MOTOR DRIVEN WHEELED VEHICLE

BACKGROUND AND SUMMARY OF THE INVENTION

This invention relates to a toy self-propelled automobile of the type which reverses direction when it strikes an obstacle.

It is especially directed to a realistically appearing toy automobile in which the reversing mechanism is integrated into the design of the automobile.

Toy automobiles which reverse direction when they strike an object are known in the art. Examples of such toys can be found in Lohr et al. U.S. Pat. No. 2,146,021 and Saunders, Jr. U.S. Pat. No. 2,625,831. In the toys shown in these patents, the reversing mechanisms were obviously add-ons of a type which are not found on authentic automobiles. Additionally, the reversing mechanisms shown in these patents utilize the shifting of gears to reverse direction of the vehicle. This can cause problems due to improper meshing of the gears when high torque motors such as pull string inertia mechanisms are used to drive the vehicle.

Therefore, an object of this invention is a realistically appearing toy automobile which reverses direction when it strikes an obstacle.

Another object of this invention is a reversing mechanism which is sufficiently sturdy to be used on a vehilce that is propelled by a pull string inertia mechanism.

Another object of this invention is a reversing mechanism that changes the direction of rotation of the driven axle in a positive manner.

Another object of this invention is a reversing mechanism for a toy automobile which does not depend upon the shifting of gears to reverse direction of the automobile but uses a sliding clutch mechanism.

Another object of this invention is a reversing mechanism for a toy automobile which will not accidentally change direction of movement during operation of the vehicle unless there is a substantial impact at the front or rear of the vehicle.

Other objects may be found in the following specification, claims and drawings.

BRIEF DESCRIPTION OF THE DRAWINGS

The invention is illustrated more or less diagrammatically in the following drawings wherein:

FIG. 5 is an enlarged, exploded view of the driven axle clutch member and spur gears with the driven axle omitted for clarity;

FIG. 6 is a left side elevational view of the clutch member as viewed in FIG. 5;

FIG. 7 is a right side elevational view of the clutch member as viewed in FIG. 5;

FIG. 8 is a right side elevational view of the left side sprocket gear as viewed in FIG. 5;

FIG. 9 is a view, partially in cross-section taken along line 9—9 of FIG. 1;

FIG. 10 is a side elevational view of the retaining member shown in FIG. 9 with a wall of the motor assembly shown in phantom;

FIG. 11 is a side elevational view of the inside face of the winding gear of the motor assembly with the drive pawls shown in phantom;

FIG. 12 is an end elevational view of the main winding gear and string spool of the motor assembly with parts broken away and others shown in cross-section;

FIG. 13 is a side elevational view of the inside face of the string spool of the motor assembly;

DESCRIPTION OF THE PREFERRED EMBODIMENT

Figure 1:
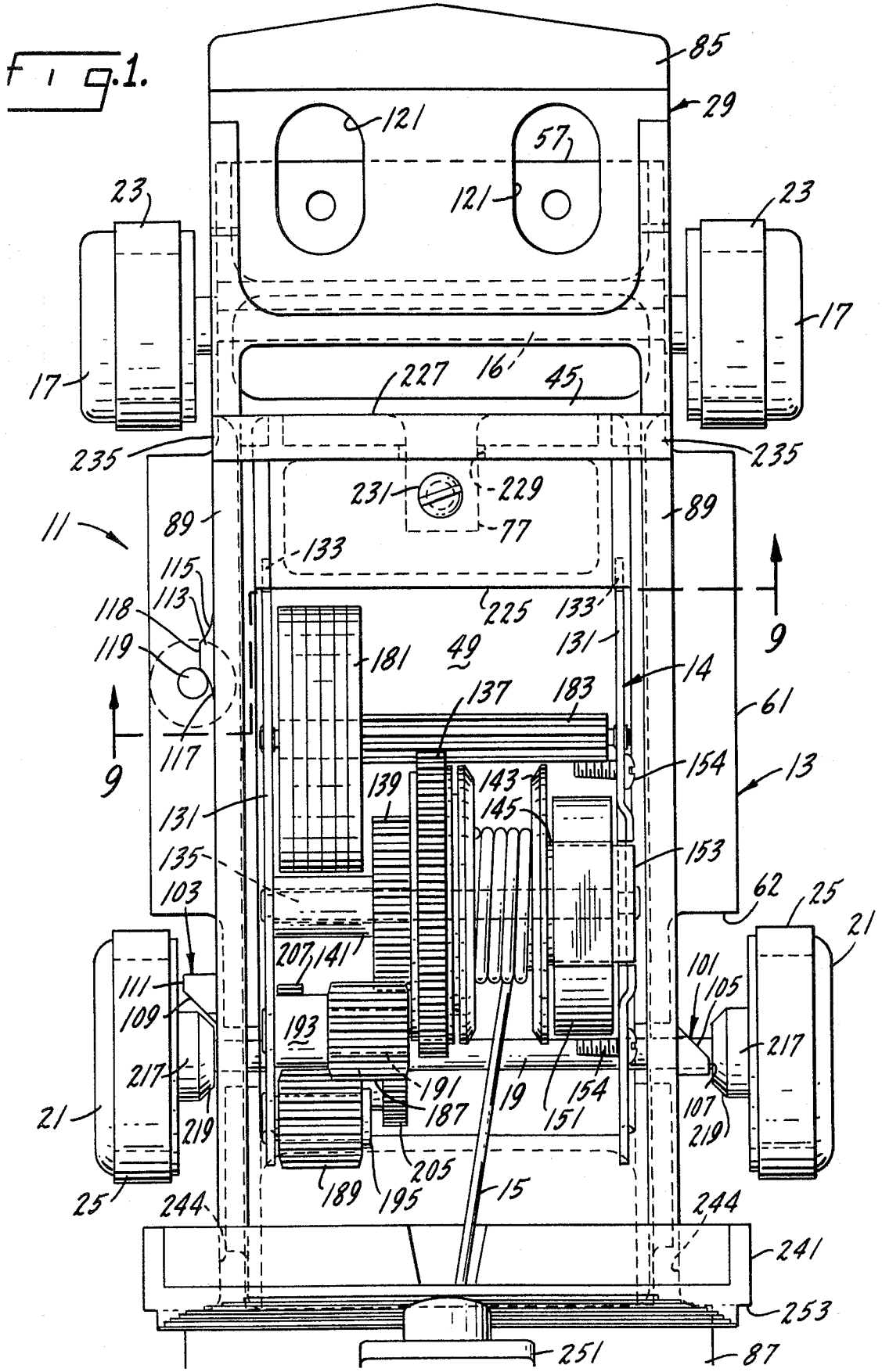
FIG. 1 is a top plan view on an enlarged scale of the toy vehicle chassis and drive mechanism of the invention with the body shell removed.

This invention is shown embodied in a chassis 11 formed of plastic for a toy automobile. The toy automobile is completed by the attachment of any suitable body (not shown) to the chassis. The body is conventionally molded of plastic and may be suitably decorated by painting or otherwise to resemble a conventional automobile.

The chassis 11 includes a frame 13 formed of a suitable plastic such as ABS, and a motor assembly 14, which in this embodiment is an inertia type motor energized by a recoil pull string 15. Mounted on the frame 13 is a fixed front axle 16 having wheels 17 at the ends thereof and a rear driven axle 19 having wheels 21 mounted thereon. Tires 23 and 25 are mounted respectively on the wheels 17 and 21. An impact actuated sliding member 29 for reversing the direction of the movement of the vehicle is mounted on the frame.

Figure 14:
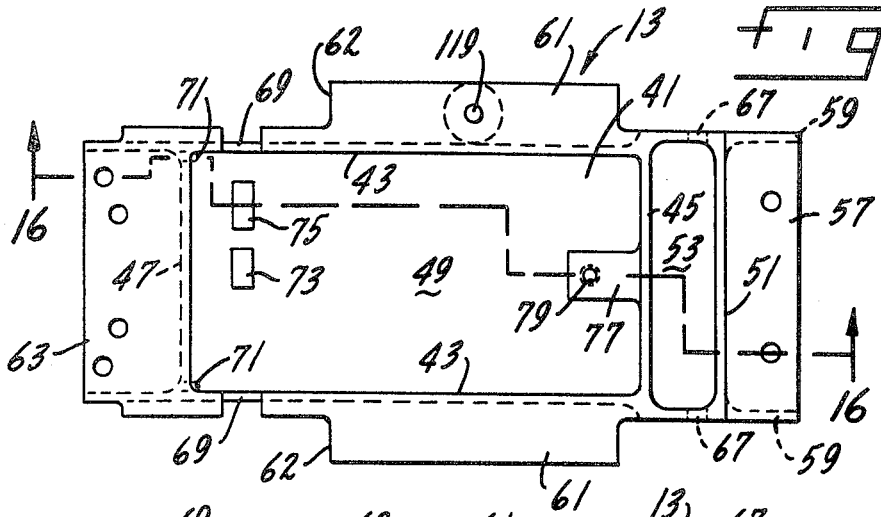
FIG. 14 is a top plan view of the frame of the toy vehicle of FIG. 1.
Figure 15:
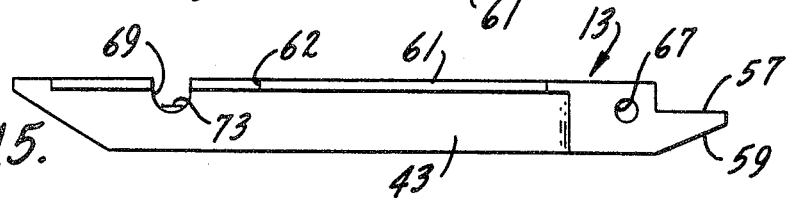
FIG. 15 is a side elevational view of the frame of FIG. 14.
Figure 16:
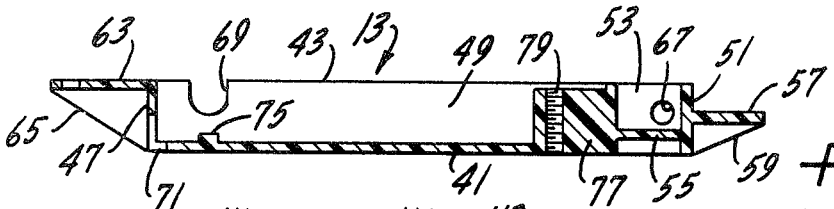
FIG. 16 is a cross-sectional view taken along lines 16—16 of FIG. 14.

The frame 13 shown separately in FIGS. 14, 15 and 16 is in the shape of a rectangular box having a bottom wall 41 and side walls 43. A transverse partition 45 and a rear wall 47 cooperate with the side walls to form a motor well 49. The frame also has a front wall 51 which cooperates with the transverse partition 45 and the side walls 43 to define a front axle well 53. This well has a bottom wall 55 which is raised relative to the bottom wall 41 of the frame. A front platform 57 extends from the front wall 51 and is supported at its sides by triangular-shaped braces 59.

Platforms 61 are formed integrally with the side walls 43 of the frame 13 and extend along the length of the motor well 49. The platforms are cut away at 62 to provide clearance for the rear wheels 21. A rear platform 63 extends from the rear wall 47 to the frame and is supported at its sides by triangular shaped braces 65. Circular openings 67 are formed in the side walls 43 of the frame in alignment with the front axle well 53 to receive the front axle 16 and provide journal surfaces therefor. Notches 69 are cut in the side walls 43 and platforms 61 of the frame near the rear of the motor well to receive the rear axle 19. Slots 71 are cut in the bottom wall 41 and the rear wall 47 of the frame to anchor the motor assembly 14 in a manner to be later described in detail. A pair of upstanding blocks 73 and 75 are formed on the bottom wall 41 of the frame in alignment with the axle notches 69. The block 73 is taller than the block 75. Another upstanding block 77 is formed in the engine well adjacent the center of the transverse partition 45. A threaded opening 79 is formed in the top surface of this block.

Figure 17:
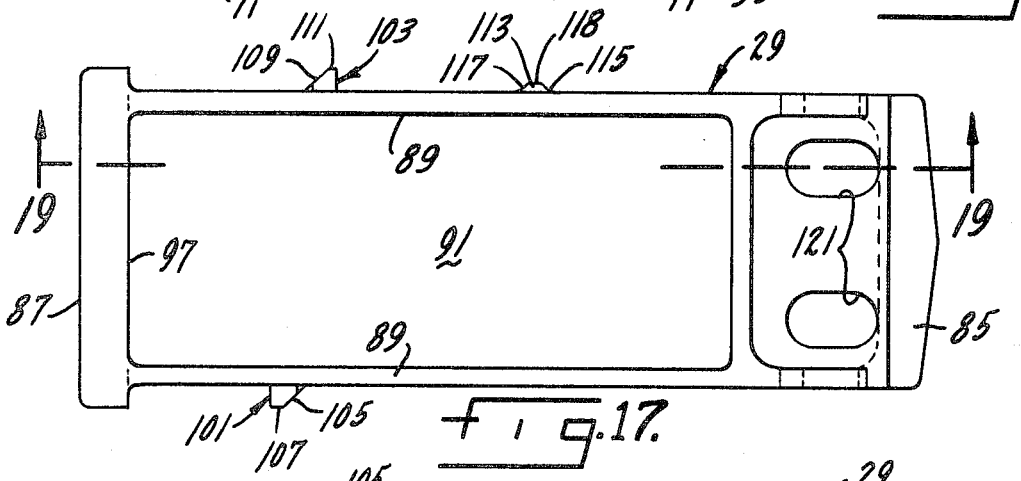
FIG. 17 is a top plan view of the bumper sliding member of FIG. 1.
Figure 18:
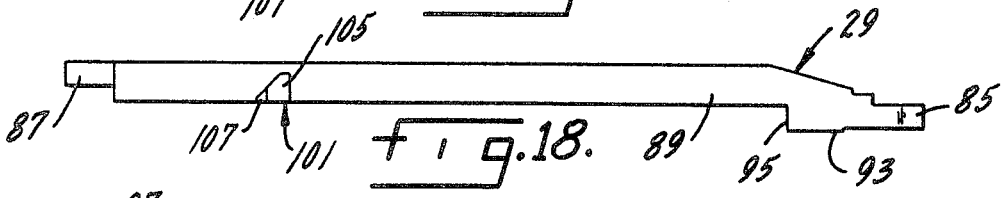
FIG. 18 is a side elevational view of the bumper sliding member of FIG. 17.
Figure 19:
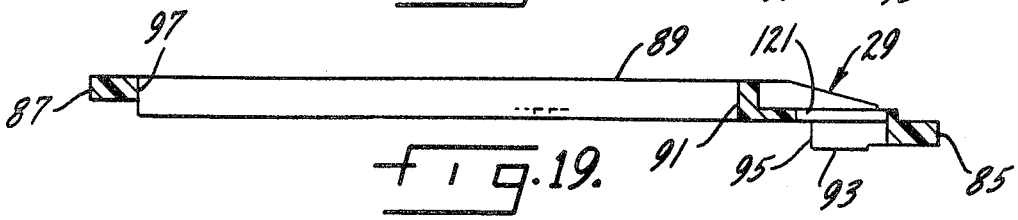
FIG. 19 is a cross-sectional view taken along line 19—19 of FIG. 17.

The impact actuated sliding member 29 shown separately in FIGS. 17, 18 and 19 and assembled with the chassis 11 in FIGS. 1, 2, 3 and 9 is formed of a suitable plastic such as ABS and includes a front bumper portion 85, a rear bumper portion 87 and side beams 89 forming a generally rectangular structure with an open center 91. The sliding member 29 rests on the side platforms 61 of the frame 13 with the motor well 49 of the frame located within the open center 91 thereof. A downwardly offset surface 93 is formed adjacent the front bumper 85 with this surface riding on the front platform 57 of the frame. The downwardly offset surface 93 terminates in a rearwardly facing wall 95 which engages the front wall 51 of the frame to limit rearward movement of the sliding member 29. The rear bumper 87 has a forwardly facing wall 97.

Laterally extending projections 101 and 103 are formed respectively on the right and left hand side beams 89 of the sliding member 29 and are positioned near the rear bumper portion 87. The laterally extending projection 101 on the right hand side has a 45° cam surface 105 facing forward and a retaining surface 107 at the free end thereof. Laterally extending projection 103 on the left hand side beam 89 is located forward of projection 101 and has a rearwardly facing 45° cam surface 109 formed thereon. It also has a retaining surface 111 located at the free end thereof.

Another laterally extending projection 113 is located on the left hand side beam 89. This projection has arcuate surfaces 115 and 117 facing forward and rearwardly respectively and separated by projecting surface 118. The lateral extending projection 113 engages an upstanding cylindrical post 119 (FIG. 1) formed on a side platform 61 of the frame 13 to function as a detent to hold the sliding member 29 in either of its forward or rearward positions. As the projection 113 is moved past the cylindrical post 119, the post engages the projecting surface 118 thus deflecting the side beam 89 of the sliding member 29 laterally. This lateral deflection of the side beam provides a spring effect which prevents the sliding member from stopping between its forward and rearward positions. Elongated openings 121 are formed in the sliding member 29 near the front bumper 85. These openings permit access to the front platform 57 of the frame in order to attach a body to the frame.

The motor assembly 14 shown assembled in FIGS. 1–4, 9 and 10 includes side walls 131 of steel having forwardly and rearwardly extending ears 133 at the bottom of the side walls. The side walls 131 are spaced apart so that the motor assembly fits snugly into the motor well 49. A main axle 135 formed of steel is mounted in openings formed in the side walls 131 of the motor assembly and is held to the walls by rivets. A main winding gear 137 is journalled on the main axle 135 and has an integral pinion gear 139 on one side thereof for rotation therewith. A spacer tube 141 is positioned between the pinion gear and the left hand side wall 131 of the motor assembly as viewed in the drawings. A string spool 143 is also journalled on the axle 135 on the other side of the main winding gear 137 from the pinion gear 139. The string spool has a laterally extending hub 145 in which is formed a pair of spring slots 147 thus creating a spring retaining tine 149. A coil spring 151 is wrapped around the hub with one end engaging the spring tine 149 and the other end anchored to an L-shaped spring retainer 153 attached by the adjacent side wall 131 of the motor assembly. Screws 154 extending through the side wall 131 limit expansion of the spring.

The main winding gear 137 is cup shaped having an annular recess 155 facing the string spool 143 as shown in FIGS. 11, 12 and 13. Inwardly directed ratchet teeth 157 are formed integrally with the main winding gear inside the annular recess. A centrifugal uni-directional drive means 159 is mounted on the string spool 143 and extends inside the annular recess 155 of the winding gear. The centrifugal uni-directional drive means includes pawls 161 which are pivotally mounted in openings 162 formed in an hour-glass shaped projection 163 formed on the side of the string spool facing the winding gear. The pawls are biased to a retracted position by a spring member 164. The retracted positions of the pawls are at the waist of the hour-glass shaped projection 163. The pawls which are made of a relatively dense material such as brass terminate at their outer and free ends 165 in relatively heavy mass members having teeth 166. Therefore, when the string spool 143 rotates fast enough, the pawls 161 are flung outwardly by centrifugal force. When flung outwardly, the tooth 166 of a pawl engages the ratchet teeth 157 of the main winding gear 137.

The spring member 164 is preferably an integrally cast plastic part. The plastic may be material, such as nylon, which has a good memory and spring like quality. Spring member 164 includes a central hub like member 171 which fits over a hub 172 of the spring spool 143 and is keyed by integral projections 173 which fit into holes in the spring spool to turn with the string spool as it is rotated by the pull string. Extending outwardly from opposite sides of the hub member 171 are two leaf springs 174 which are suitably arched to achieve better spring qualities. The outer ends of the leaf springs terminate in flat tabs 175 which normally bear against flat surfaces 177 on the pawls 161. The flat tabs and flat surfaces normally come together in face to face contact to bias the pawls to a normal and retracted position where they do not engage the ratchet teeth 157 of the main winding gear 137. It is to be noted that, in the driving mode, the flat surface 177 on the pawls are displaced from the flat spring tabs 175 on leaf springs 173. Therefore, on recoil, the tension in leaf springs 174 presses against the flats on the pawls to retract and return them to a position where the flat tabs 175 and flat surfaces 177 are in face to face contact. Thus, the.spring means 164 keeps the pawls retracted except when centrifugal force moves them to the driving position.

Figure 2:
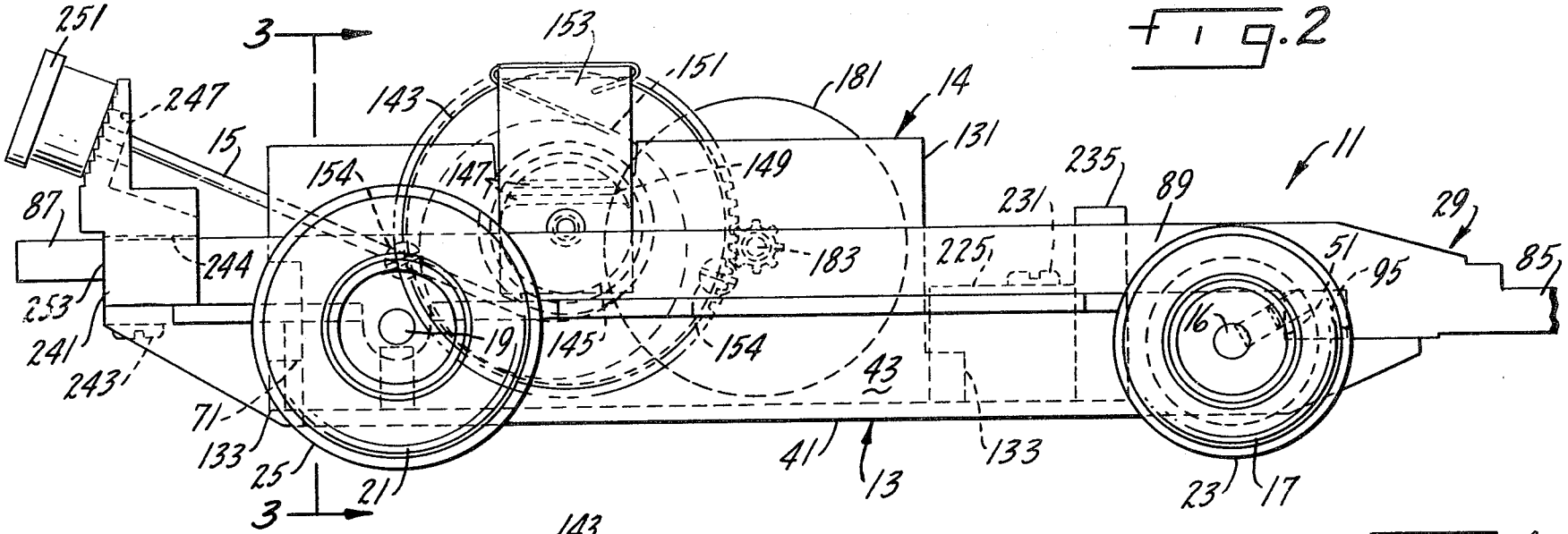
FIG. 2 is a side elevational view of the toy vehicle of FIG. 1.
Figure 4:
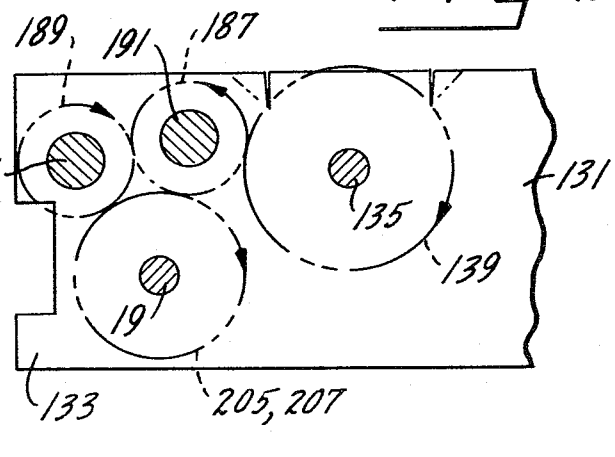
FIG. 4 is a schematic view taken along line 4—4 of FIG. 3.

A flywheel 181 shown in FIGS. 1 and 2 and preferably formed of laminated metal discs, is affixed to one end of a pinion shaft 183 which is journalled in openings in the side walls 131 of the motor assembly. The pinion shaft 183 meshes with the teeth of main winding gear 137 and is driven by the rotation of the winding gear.

A pair of meshing brass idler gears 187 and 189 (see FIGS. 1, 3 and 4) are mounted on a side wall 131 of the motor assembly 19. Forward idler gear 187 is mounted on a pin 191 riveted to the side wall and having a spacer portion 193. Idler gear 187 meshes with the pinion gear 139 of the main winding gear 137. The reverse idler gear 189 is mounted on pin 195 adjacent the side wall 131.

Figure 3:
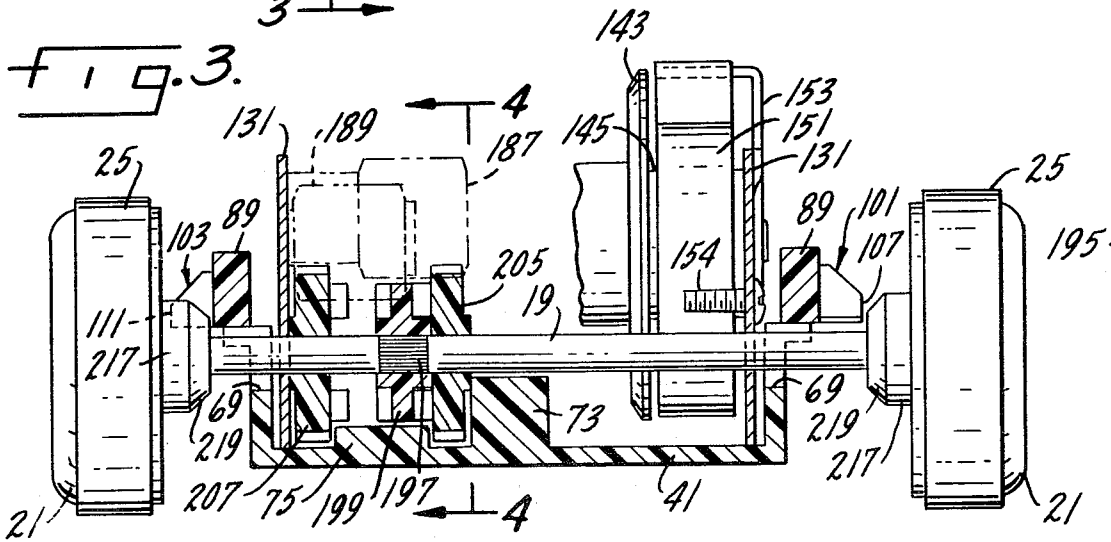
FIG. 3 is a cross-sectional view taken along line 3—3 of FIG. 2 with some parts broken away and others shown in phantom.

The rear driven axle 19 is journalled in openings in the side walls 131 of the motor assembly 14 as is most clearly shown in FIG. 3. A portion of the rear axle is knurlled at 197. A clutch member or dog 199 also shown in FIGS. 5, 6 and 7 in more detail is force fitted over the knurlled portion of the shaft so that it will rotate with the rear axle 19. The clutch member 199 has one-way clutch teeth 201 on one side and one way clutch teeth 203 facing in the opposite direction of rotation on the other side. Spur gears 205 and 207 are rotationally mounted on the rear axle 19 and the axle is free to slide laterally through these gears. Spur gear 205 has one-way clutch teeth 209 facing the clutch member 199 and spur gear 207 has one way clutch teeth 211 also facing the clutch member 199. Spur gear 205 meshes with the forward driving idler gear 187 (see FIG. 4) while spur gear 207 meshes with the rearward driving idler gear 189 (see FIG. 3). Spur gear 205 is captured against lateral movement along the rear axle 19 by being located between blocks 73 and 75 which project upwardly from the bottom wall 41 of the frame 17. Spur gear 207 is held against lateral movement by being located between the block 75 and a side wall 131 of the motor assembly 19.

Wheels 21 are affixed near the ends of the rear axle 19. Each wheel has a hub 217 which has an angular cam surface 219. Each angular cam surface 219 is engaged by a cam surface 105 or 109 of the laterally extending projections 101 and 103 located on the side beams 89 of the sliding member 29. The engagement of the cams on the laterally extending projections with the cams as the hubs slide the rear axle 19 in one direction or the other to engage and the one way teeth on the spur gears 205 or 207 with the one way clutch teeth on the clutch member 199 to drive the car either forward or in reverse.

The sliding member 29 is held onto the frame 13 by a front retainer member 255 which is positioned at the forward end of the motor well 49 and is shown in FIGS. 1, 2, 9 and 10. The front retainer member is a hollow structure having a front wall 227 which rests against transverse partition 45 and on the bottom wall 41 of the frame 13. A cutout 229 is formed in the front wall and the cutout fits over and receives the block 77 which is formed integrally with the frame 13. The front retainer is held in place by a screw 231 which fits in the threaded opening 79 in the block 77. The front retainer also has side projections 233 which fit over the ears 133 of the side walls 131 of the motor assembly 14 to hold the motor assembly in place in the motor well. Also formed integrally with the front retainer at the top thereof are laterally extending projections 235 which fit over the side rails 89 of the sliding member 29 to hold it in place on the frame 13.

A rear retainer 241 shown in FIGS. 1 and 2 is also provided to hold the sliding member 29 onto the frame 13. The rear retainer is held to the frame by screws 243. It has slots 244 which receive the side beams 89 of the sliding member 29. The rear retainer also has an opening 247 which receives the pull string and prevents passage of the pull spring tab 251 through this opening. The pull string is attached to the string spool 143 by knotting through a hole 252 in the spool. The pull string tab is decorated to function as a license plate. The rear wall 253 of the rear retainer also acts as a stop for the rear bumper 87 of the sliding member 29 to limit forward movement of the sliding member.

We claim:

1. A reversing mechanism for a toy motor driven wheeled vehicle having a driven axle with attached wheels supported on a chassis, the axle being supported on the chassis so that it is shiftable laterally relative to the chassis, the reversing mechanism including:

means to shift the driven axle laterally relative to the chassis between forward and reverse driving positions upon engagement of the front or rear of the vehicle with a firm obstructing object, a pair of spur gears positioned on the driven axle and spaced in generally fixed relation to each other with each gear freely rotatable on the driven axle and the driven axle freely slidable through the gears, a clutch member affixed to the driven axle for rotation therewith and positioned between the spur gears, the clutch member having rotationally oppositely effective one-way clutch teeth on the sides thereof facing the spur gears, complementary one-way clutch teeth formed on the sides of the spur gears facing the clutch member and engageable with the complementary one-way teeth on the clutch member as the clutch member is moved into engagement with one of the spur gears and out of engagement with the other spur gear upon lateral shifting of the driven axle to one of the forward and reverse driving positions, and a toy vehicle motor and a pair of oppositely rotatable idler gears driven by the toy vehicle motor, each idler gear meshing with one of the spur gears to thereby drive the driven axle through the spur gear that is in engagement with the clutch member.

2. The reversing mechanism of claim 1 in which the means to shift the driven axle laterally relative to the chassis includes bumper means located on and extending beyond the front end and rear of the chassis, means mounting the bumper means on the chassis for sliding movement forward and rearwardly relative thereto, and two sets of cams and cam followers mounted on the bumper means and the driven axle and arranged so that movement of the bumper means in a forward direction relative to the chassis will move the cam and cam follower of one set into engagement to shift the driven axle laterally to its forward driving position and movement of the bumper means in a rearwardly direction will move the cam and cam follower of the other set into engagement to shift the driven axle laterally to its reverse driving position.

3. The reversing mechanism of claim 2 further characterized in that the bumper means includes bumpers at the front and rear of the chassis and side beams extending between the front and rear bumpers with the cams of the set of cams formed as lateral projections on the side beams and the wheels of the driven axles having hubs with the cam followers of the sets of cams and cam followers formed on the hubs.

4. The reversing mechanism of claim 3 further characterized in that means are provided to retain the driven axle in its shifted lateral positions.

5. The reversing mechanism of claim 4 in which the means to retain the driven axle in its shifted lateral positions include engaging stop surfaces formed on each cam projection and on each wheel hub.

6. The reversing mechanism of claim 2 further characterized by detent means to hold the bumper means in defined forward and rearward positions relative to the chassis.

7. A transmission for a toy motor driven vehicle having a motor, an output gear driven by the motor, and a driven axle with attached wheels supported on the vehicle so that the axle is shiftable laterally relative to the vehicle, the transmission including:

a first idler gear meshing with the motor output gear, a second idler gear meshing with the first idler gear and having a portion thereof extending laterally of the first idler gear along the driven axle, a pair of spur gears positioned on the driven axle and spaced in generally fixed relation to each other with each gear freely rotatable on the driven axle and the driven axle freely slidable through the gears, each spur gear meshing with one of the idler gears, a clutch member affixed to the driven axle for rotation therewith and positioned between the spur gears, the clutch member having rotationally oppositely effective one-way clutch teeth on the sides thereof facing the spur gears, and complementary one-way clutch teeth formed on the sides of the spur gears facing the clutch member and engageable with the complementary one-way teeth on the clutch member as the clutch member is moved into engagement with one of the spur gears and out of engagement with the other spur gear upon lateral shifting of the driven axle.

8. A reversing mechanism for a toy motor driven wheeled vehicle having a driven axle with attached wheels supported on a chassis, the reversing mechanism including:

an impact actuated member mounted on the chassis for fore and aft movement relative thereto in response to an impact, forwardly and rearwardly motor driven rotational gears mounted on the driven axle and free to rotate relative to the axle, a clutch member fixed to the driven axle for rotation therewith, and means attached to the impact actuated member to alternately engage the clutch member to the forwardly driven or to the rearwardly driven rotational gears in accordance with the forward or rearward position of the impact actuated member relative to the chassis.

9. The reversing mechanism of claim 8 in which complementary stop surfaces are carried by the chassis and the impact actuated member to limit forward and rearward movement of the chassis and impact actuated member relative to each other upon engagement of the stop members.

10. The reversing mechanism of claim 8 in which the impact actuated member includes front and rear bumpers connected by side beams and the means to alternately engage the clutch member to the forwardly driven or to the rearwardly driven rotational gears are actuated by movement of the side beams.

11. The reversing mechanism of claim 9 in which the motor for the wheeled vehicle is located in a motor housing and the motor housing is mounted on the chassis and located inwardly of the front and rear bumpers and side beams of the impact actuated member.

* * * * *